US011574614B2

(12) United States Patent
Ma et al.

(10) Patent No.: US 11,574,614 B2
(45) Date of Patent: Feb. 7, 2023

(54) SWITCHING METHOD AND SWITCHING DEVICE FOR DISPLAY CHANNEL, DISPLAY DRIVING DEVICE AND DISPLAY DEVICE

(71) Applicant: BOE Technology Group Co., Ltd., Beijing (CN)

(72) Inventors: Xitong Ma, Beijing (CN); Lihua Geng, Beijing (CN); Xianzhen Li, Beijing (CN); Donglei Mu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 39 days.

(21) Appl. No.: 16/945,243

(22) Filed: Jul. 31, 2020

(65) Prior Publication Data

US 2021/0056938 A1 Feb. 25, 2021

(30) Foreign Application Priority Data

Aug. 19, 2019 (CN) ..... 201910764595.0

(51) Int. Cl.
*G09G 5/39* (2006.01)
*G09G 5/397* (2006.01)
*G09G 3/20* (2006.01)

(52) U.S. Cl.
CPC ..... *G09G 5/397* (2013.01); *G09G 3/20* (2013.01); *G09G 2310/08* (2013.01)

(58) Field of Classification Search
CPC ..... G09G 3/20; G09G 2310/08; G09G 5/397
See application file for complete search history.

(56) References Cited

U.S. PATENT DOCUMENTS

| | | | | |
|---|---|---|---|---|
| 5,065,346 | A | 11/1991 | Kawai et al. | |
| 6,335,728 | B1 | 1/2002 | Kida et al. | |
| 2004/0095356 | A1* | 5/2004 | Inoue | G09G 5/393 345/531 |
| 2018/0158424 | A1* | 6/2018 | Okamoto | G09G 5/391 |

FOREIGN PATENT DOCUMENTS

| | | | |
|---|---|---|---|
| CN | 1682274 | A | 10/2005 |
| CN | 107924666 | A | 4/2018 |
| JP | 2000-13639 | A | 1/2000 |

OTHER PUBLICATIONS

Office Action dated May 19, 2021 issued in corresponding Chinese Application No. 201910764595.0.

* cited by examiner

*Primary Examiner* — Roy P Rabindranath
(74) *Attorney, Agent, or Firm* — Nath, Goldberg & Meyer; Joshua B. Goldberg

(57) ABSTRACT

The present disclosure provides a method and device for switching a display channel, a display driving device and a display device. The method includes: sending a first switching signal to a write controller of a current display channel when a switching instruction for switching from the current display channel to a target display channel is received; acquiring a frame address in which final write operation of data is completed, and taking the frame address as a first address and a next frame address as a second address; sending a second switching signal to a write controller of the target display channel; and sending a third switching signal to a read controller.

18 Claims, 5 Drawing Sheets

Prior Art

SWITCHING METHOD AND SWITCHING DEVICE FOR DISPLAY CHANNEL, DISPLAY DRIVING DEVICE AND DISPLAY DEVICE

CROSS-REFERENCE TO RELATED APPLICATIONS

The present application claims the priority of Chinese Patent Application No. 201910764595.0 filed on Aug. 19, 2019, the entire contents of which are incorporated herein by reference.

TECHNICAL FIELD

The present disclosure relates to the field of display technology, and in particular, to a method, and a device for switching display channel, a display driving device and a display device.

BACKGROUND

Switching between different display channels can be performed in an ultra-high-definition display system to display video images of different specifications (e.g. 4K and 8K). Switching efficiency of the display channels directly affects users' viewing experience.

SUMMARY

In one aspect, a method for switching a display channel is provided, and includes: sending a first switching signal to a write controller of a current display channel when receiving a switching instruction for switching from the current display channel to a target display channel is received, so as to control the write controller of the current display channel to stop writing image data to a memory; acquiring a frame address in which final write operation of data is completed in the memory, and taking the frame address as a first address and a frame address immediately after the first address as a second address; sending a second switching signal to a write controller of the target display channel, so as to enable the write controller of the target display channel to, starting from the second address, sequentially write frames of image data of the target display channel into frame addresses of the memory in a predetermined order; and sending a third switching signal to a read controller to enable the read controller to, starting from the first address, sequentially read the image data from the frame addresses of the memory in the predetermined order after the read controller finishes reading the data from the first address under the control of a read control signal.

In one embodiment, the step of sending the first switching signal to the write controller of the current display channel includes: synchronizing the switching instruction to a clock domain of a field synchronization signal of the current display channel to generate the first switching signal, and sending the first switching signal to the write controller of the current display channel.

In one embodiment, the first switching signal is a pulse signal, a pulse width of which is smaller than that of the field synchronization signal of the current display channel, and a falling edge of the first switching signal and a falling edge of the switching instruction occur at the same time.

In one embodiment, the step of sending the second switching signal to the write controller of the target display channel includes: synchronizing the switching instruction to a clock domain of a field synchronization signal of the target display channel to generate the second switching signal, and sending the second switching signal to the write controller of the target display channel.

In one embodiment, the second switching signal is a pulse signal, a pulse width of which is smaller than that of the field synchronization signal of the target display channel, and a falling edge of the second switching signal and a falling edge of a pulse, immediately after the switching instruction, of the field synchronization signal of the target display channel occur at the same time.

In one embodiment, the step of sending the third switching signal to the read controller includes: synchronizing the switching instruction to a current clock domain of the read control signal to generate the third switching signal, and sending the third switching signal to the read controller.

In one embodiment, the third switching signal is a pulse signal, a pulse width of which is smaller than that of the read control signal, and a falling edge of the third switching signal and a falling edge of a pulse of the read control signal immediately after the switching instruction occur at the same time.

In one embodiment, the read control signal, the field synchronization signal of the current display channel, and the field synchronization signal of the target display channel have a same timing. The read control signal is synchronized with the field synchronization signal of the current display channel. The read control signal is not synchronized with the field synchronization signal of the target display channel.

In another aspect, a device for switching a display channel is provided, and includes: a processor; and a storage with computer executable instructions stored therein, when the computer executable instructions are executed, the processor performs the following steps: receiving a switching instruction for switching from a current display channel to a target display channel; sending a first switching signal to a write controller of the current display channel when the switching instruction is received, so as to control the write controller of the current display channel to stop writing image data to a memory; acquiring a frame address in which final write operation of data is completed, and taking the frame address as a first address and a frame address immediately after the first address as a second address when the first switching signal is received by the write controller of the current display channel; sending a second switching signal to a write controller of the target display channel to enable the write controller to, starting from the second address, sequentially write frames of image data of the target display channel into frame addresses of the memory in a predetermined order; and a sending a third switching signal to a read controller, so as to enable the read controller to, starting from the first address, sequentially read the image data from the frame addresses of the memory in the predetermined order after the read controller finishes reading the data from the first address under the control of a read control signal.

In one embodiment, the step of sending the first switching signal to the write controller of the current display channel comprises: synchronizing the switching instruction to a clock domain of a field synchronization signal of the current display channel to generate the first switching signal, and sending the first switching signal to the write controller of the current display channel.

In one embodiment, the first switching signal is a pulse signal, a pulse width of which is smaller than that of the field synchronization signal of the current display channel, and a falling edge of the first switching signal and a falling edge of the switching instruction occur at the same time.

In one embodiment, the step of sending the second switching signal to the write controller of the target display channel comprises: synchronizing the switching instruction to a clock domain of a field synchronization signal of the target display channel to generate the second switching signal, and sending the second switching signal to the write controller of the target display channel.

In one embodiment, the second switching signal is a pulse signal, a pulse width of which is smaller than that of the field synchronization signal of the target display channel, and a falling edge of the second switching signal and a falling edge of a pulse, immediately after the switching instruction, of the field synchronization signal of the target display channel occur at the same time.

In one embodiment, the step of sending the third switching signal to the read controller comprises: synchronizing the switching instruction to a current clock domain of the read control signal to generate the third switching signal, and sending the third switching signal to the read controller.

In one embodiment, the third switching signal is a pulse signal, a pulse width of which is smaller than that of the read control signal, and a falling edge of the third switching signal and a falling edge of a pulse of the read control signal immediately after the switching instruction occur at the same time.

In one embodiment, a pulse interval of the read control signal, a pulse interval of the field synchronization signal of the current display channel and a pulse interval of the field synchronization signal of the target display channel are equal to one another. The read control signal is synchronized with the field synchronization signal of the current display channel. The read control signal is not synchronized with the field synchronization signal of the target display channel.

In still another aspect, a display driving device is provided, and includes: the above switching device; at least two write controllers in one-to-one correspondence with at least two display channels, and are configured to respectively write image data of the corresponding display channels to the memory in a time-division manner under the control of the field synchronization signals of the corresponding display channels; and the read controller configured to read the image data from the memory under the control of the read control signal.

In still another aspect, a display device is provided, and includes the above display driving device and a display module configured to display based on the image data read by the read controller.

BRIEF DESCRIPTION OF THE DRAWINGS

The accompanying drawings are intended to provide a further understanding of the present disclosure, and are incorporated in and constitute a part of the Specification. The drawings, together with the specific embodiments below, are intended to explain the present disclosure, but do not constitute a limitation on the present disclosure. In the drawings.

DETAILED DESCRIPTION

The specific embodiments of the present disclosure are described in detail below with reference to the accompanying drawings. It should be understood that the specific embodiments described herein are merely for illustrating and explaining the present disclosure, but are not intended to limit the present disclosure.

Figure 1:
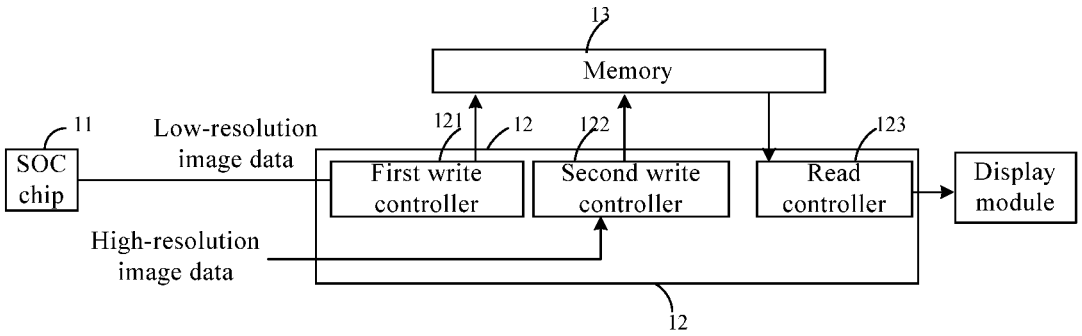
FIG. 1 is a block diagram illustrating a structure of a display system in the prior art.

FIG. 1 is a block diagram illustrating a structure of a display system in the prior art. As shown in FIG. 1, the display system includes a system on chip (SOC) 11, a field programmable gate array (FPGA) chip 12, and a memory 13. During displaying, the FPGA chip 12 caches display data of a plurality of frames of images to be displayed in the memory, and then outputs the display data stored in the memory 13 to a display module. During double-channel display, the SOC 11 may process image data of low-resolution images (e.g. 4K images, that is, images with a resolution of 3840×2160 or 4096×2160), and send the image data to the FPGA chip 12. An image source directly sends image data of high-resolution images (e.g. 8K images, that is, images with a resolution of 7680×4320) to the FGPA chip 12.

When the display system operates in a low-resolution channel, the SOC 11 transmits image signals of the frames of a low-resolution image to the FPGA chip 12, and a first write controller 121 of the FPGA chip 12 sequentially writes the image signals of the frames of images to frame addresses of the memory 13 respectively under the control of a field synchronization signal of the low-resolution channel; after the first write controller 121 completes the write operation of the image data of one or more frames, a read controller 123 begins to read the data from the frame addresses, and outputs the read data to the display module. The frequency or speed at which the read controller 123 reads the data may be the same as the frequency or speed at which the first write controller 121 writes the data.

When the display system operates in a high-resolution channel, the high-resolution images from the image source are input to the FPGA chip 12 via a high definition multimedia interface (HDMI) port, a second write controller 122 of the FPGA chip 12 sequentially writes image data of the frames of images to the frame addresses of the memory 13 respectively under the control of a field synchronization signal of the high-resolution channel; similar to the operation in the low-resolution channel, after the second write controller 122 completes the write operation of the image data of one frame, the read controller 123 begins to read the image data from the frame addresses, and outputs the read image data to the display module. The frequency at which the read controller 123 reads the data may be the same as the frequency at which the second write controller 122 writes the data.

For switching a display channel in the related art, each of write controllers and read controller need to be reset, and then the write controller of the display channel to which the channel switching is switched writes data into the frame addresses of the memory 13 from the first frame address of the memory 13 again, which results in longer switching time (typically about 1 second or even longer) and thus a poor user experience.

Figure 2:
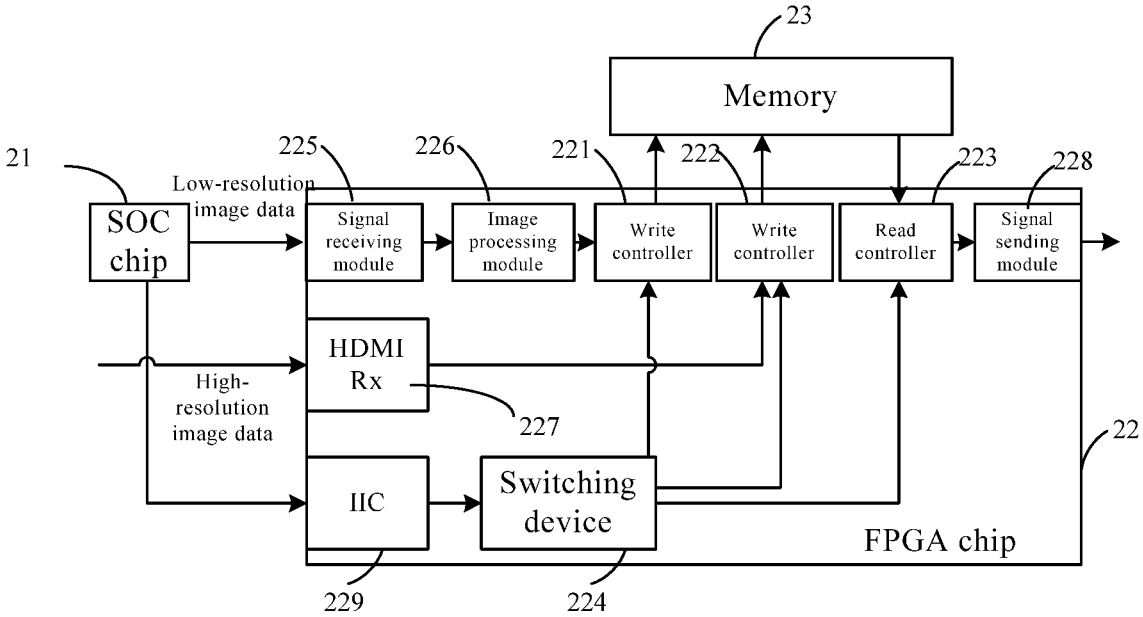
FIG. 2 is a schematic diagram of a display driving device according to the embodiments of the present disclosure.

A method for switching a display channel is provided according to the embodiments of the present disclosure, and is applied to a display driving device. As shown in FIG. 2, the display driving device includes an SOC 21, an FPGA chip 22 and a memory 23. The memory 23 may be a double data rate (DDR) synchronous dynamic random access memory (SDRAM), and may employ three frame addresses for caching. The FPGA chip 22 includes two write controllers 221 and 222, a read controller 223, and a switching device 224. The write controllers 221 and 222 are configured to sequentially write image data of a corresponding display channel to the frame addresses of the memory 23 under the control of a field synchronization signal of the corresponding display channel; and the read controller 223 is configured to sequentially read the image data from the frame addresses of the memory 23 under the control of a read control signal. For example, the memory 23 has three frame addresses, that is, frame address 0, frame address 1, and frame address 2. When the display system operations in a low-resolution display channel, the corresponding write controller 221 sequentially writes the frames of image to the three frame addresses in a cyclic manner, and the read controller 223 sequentially reads the image data from the three frame addresses in a cyclic manner. Specifically, the write controller 221 sequentially writes the image data of a first frame of the low-resolution display channel into the frame address 0, writes the image data of a second frame of the low-resolution display channel into the frame address 1, writes the image data of a third frame of the low-resolution display channel into the frame address 2, writes the image data of a fourth frame of the low-resolution display channel into the frame address 0, writes the image data of a fifth frame of the low-resolution display channel into the frame address 1, and so on. In addition, while the write controller 221 is writing the image data of the second frame to the frame address 1, the read controller 223 is reading the image data of the first frame from the frame address 0; while the write controller 221 is writing the image data of the third frame to the frame address 2, the read controller 223 is reading the image data of the second frame from the frame address 1; while the write controller 221 is writing the image data of the fourth frame to the frame address 0, the read controller 223 is reading the image data of the third frame from the frame address 2, and so on. It should be understood that the memory 23 includes a plurality of cache spaces, a frame address refers to an address of a cache space, and writing data into a frame address refers to writing data into a cache space corresponding to the frame address.

Figure 3:
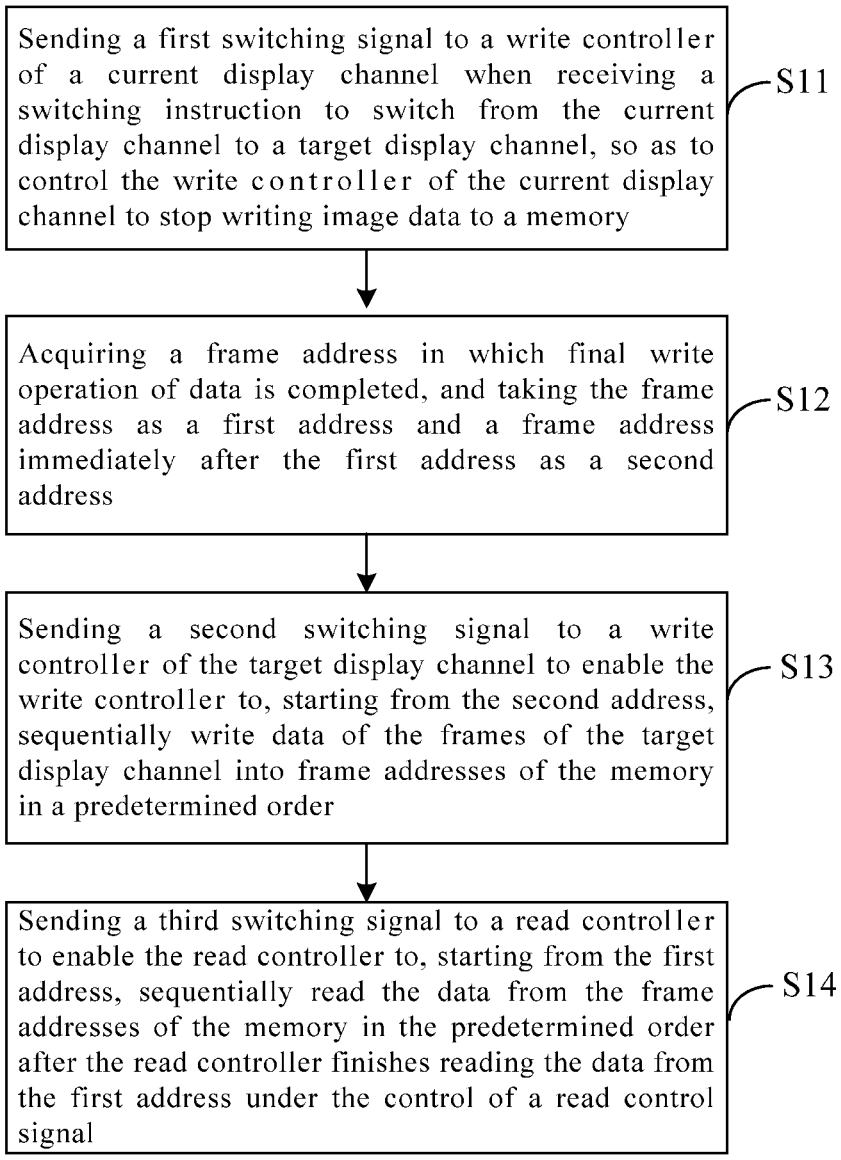
FIG. 3 is a schematic diagram illustrating a method for switching a display channel according to the embodiments of the present disclosure.

FIG. 3 is a schematic diagram illustrating a method for switching a display channel according to the embodiments of the present disclosure. As shown in FIG. 3, the switching method includes steps S11 to S14.

At step S11, a first switching signal is sent to a write controller of a current display channel when a switching instruction for switching from the current display channel to a target display channel is received, so as to control the write controller of the current display channel to stop writing image data to a memory.

The switching method may switch from a low-resolution display channel to a high-resolution display channel, and may also switch from the high-resolution display channel to the low-resolution display channel. In the case of switching from the low-resolution display channel to the high-resolution display channel, the current display channel is the low-resolution display channel, and the target display channel is the high-resolution display channel. In the case of switching from the high-resolution display channel to the low-resolution display channel, the current display channel is the high-resolution display channel, and the target display channel is the low-resolution display channel.

In order to improve the switching efficiency, an interval between the time when the first switching signal is sent and the time when the switching instruction is received should be as short as possible.

At step S12, a frame address in which final write operation of data is completed is acquired, and the frame address is taken as a first address and a frame address immediately after the first address is taken as a second address.

It should be noted that "final write operation of data is completed" refers to that the data of an entire frame has been written; for example, in a case that the write controller 221 has written the data of one frame to the frame address 1 but has not yet started writing data to the frame address 2 when the first switching signal is sent, the frame address in which the final write operation of data is completed in the memory 23 is the frame address 1. For another example, in a case that the write controller 221 writes only part of the data of one frame into the frame address 1 when the first switching signal is sent, the frame address in which the final write operation of data is completed in the memory 23 is the frame address 0.

Moreover, it should be noted that a frame address immediately after the first address refers to the next frame address to which data is to be written according to the write order of the write controller. For example, if the frame address (i.e., the first address) in which the final write operation of data is completed is the frame address 0, the frame address immediately after the first address is the frame address 1; and if the frame address in which the final write operation of data is completed is the frame address 2, the frame address immediately after the first address is the frame address 0.

At step S13, a second switching signal is sent to a write controller of the target display channel, so as to enable the write controller to, starting from the second address, sequentially write data of the frames of the target display channel to the frame addresses of the memory in a predetermined order, respectively.

The time when the switching instruction is received is different from the time when the second switching signal is sent, and the time when the second switching signal is sent is after the time when the switching instruction is received. For example, the time when the second switching signal is sent is after the time when the switching instruction is received, and the second switching signal is at the $n^{th}$ falling edge of the field synchronization signal of the target display channel, where $n>0$, and n is a smaller integer, for example, $0<n<10$.

The predetermined order is an order in which three frame addresses are written in a cycle manner (or an order in which data is read from three frame addresses in a cyclic manner), which will not be repeated here.

At step S14, a third switching signal is sent to a read controller to enable the read controller to, starting from the first address, sequentially read the data from the frame addresses of the memory in the predetermined order after the read controller finishes reading the data from the first address under the control of a read control signal. That is, the read controller continuously reads the image data from the first address twice.

The time when the third switching signal is sent may be after the time when the switching instruction is received.

In the switching method according to the embodiments of the present disclosure, when the switching instruction is received, the write controller of the current display channel stops writing data, and the frame address in which the final write operation of data is completed is taken as the first address; and the write controller of the target display channel, starting from the frame address immediately after the first address, writes data into the frame addresses in sequence. After finishing reading the data from the first address, the read controller, starting from the first address, sequentially reads the data from the frame addresses of the memory. Therefore, by controlling the frame addresses from which the data is read and the frame addresses to which the data is written, the read controller can continuously read data from the memory when the display channel is switched, without resetting each of the write controllers and read controller, thereby increasing the switching speed, and improving the user experience.

Figure 4:
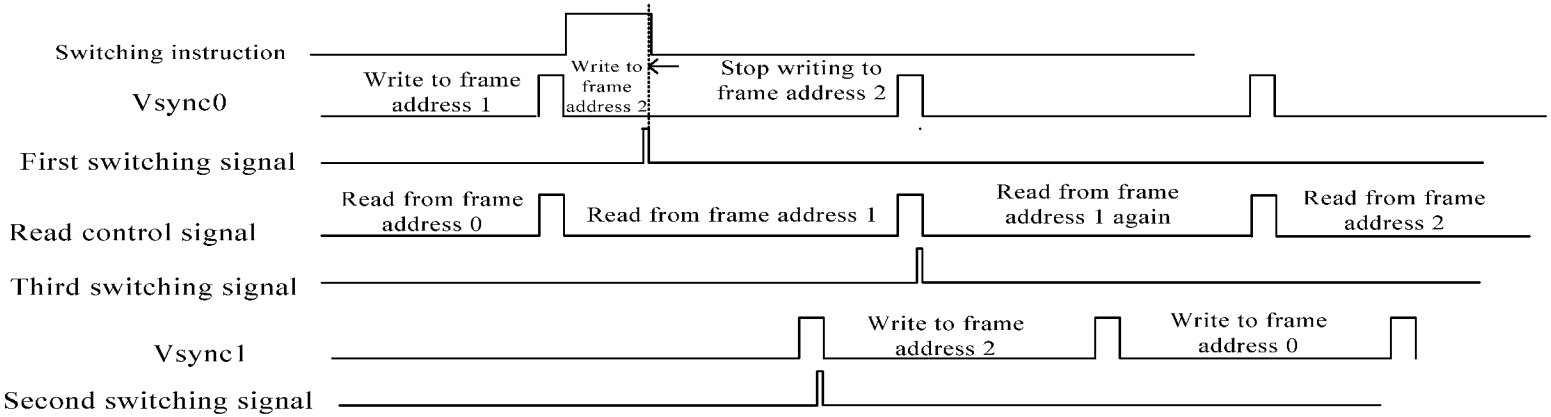
FIG. 4 is a timing diagram of signals according to the embodiments of the present disclosure.
Figure 5:
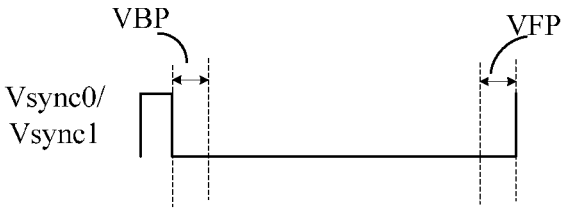
FIG. 5 is a waveform diagram of one period of a field synchronization signal.

FIG. 4 is a timing diagram of the signals in the embodiments of the present disclosure. Vsync0 represents the field synchronization signal of the current display channel, and Vsync1 represents the field synchronization signal of the target display channel. FIG. 5 is a waveform diagram of one period of the field synchronization signal. The field synchronization signal Vsync0/Vsync1 includes a vertical back porch (VBP) and a vertical front porch (VFP). The VBP refers to a pulse width after a falling edge of the field synchronization signal Vsync0/Vsync1, and the VFP refers to a pulse width before a next rising edge of the field synchronization signal Vsync0/Vsync1 adjacent to the falling edge. Each of the write controllers performs write operation during a period from the time when the VBP of the field synchronization signal of the display channel ends to the time when the VFP thereof begins.

Similarly, the read controller performs read operation during a period from the time when the VBP of the read control signal ends to the time when the VFP thereof begins. In addition, the read control signal follows the field synchronization signal of the current display channel, that is, the read control signal is the same as the field synchronization signal of the current display channel in terms of timing. When the write controller writes data into a frame address, the read controller reads the data from a frame address immediately before the frame address.

In some embodiments, step S11 of sending the first switching signal to the write controller of the current display channel, includes: synchronizing the switching instruction to a clock domain of a field synchronization signal of the current display channel to generate the first switching signal (as shown in FIG. 4), and sending the first switching signal to the write controller of the current display channel. The first switching signal is a pulse signal, a pulse width of which is smaller than that of the field synchronization signal of the current display channel.

A falling edge of the first switching signal and a falling edge of the switching instruction occur at the same time, as shown in FIG. 4.

Step 13 of sending the second switching signal to the write controller of the target display channel includes: synchronizing the switching instruction to a clock domain of a field synchronization signal of the target display channel to generate the second switching signal, and sending the second switching signal to the write controller of the target display channel.

The second switching signal is a pulse signal, a pulse width of which is smaller than that of the field synchronization signal of the target display channel. A falling edge of the second switching signal and a falling edge of the pulse, immediately after the switching instruction, of the field synchronization signal Vsync1 of the target display channel occur at the same time, as shown in FIG. 4.

Step S14 of sending the third switching signal to the read controller, includes: synchronizing the switching instruction to a current clock domain of the read control signal to generate the third switching signal, and sending the third switching signal to the read controller.

The third switching signal is a pulse signal, a pulse width of which is smaller than that of the read control signal. A falling edge of the third switching signal and a falling edge of the pulse of the read control signal immediately after the switching instruction occur at the same time.

Each of the first, second and third switching signals may have the minimum pulse width.

The read control signal, the field synchronization signal Vsync0 of the current display channel, and the field synchronization signal Vsync1 of the target display channel have the same timing. In one embodiment, a pulse interval (i.e., the interval between two adjacent pulses) of the read control signal, a pulse interval of the field synchronization signal Vsync0 of the current display channel, and a pulse interval of the field synchronization signal Vsync1 of the target display channel are equal to one another.

The read control signal is synchronized with the field synchronization signal Vsync0 of the current display channel. In one embodiment, the pulses of the read control signal are aligned with the pulses of the field synchronization signal Vsync0 of the current display channel in one-to-one correspondence.

The read control signal is not synchronized with the field synchronization signal Vsync1 of the target display channel. In one embodiment, the pulses of the read control signal are not aligned with the pulses of the field synchronization signal Vsync1 of the target display channel.

In one embodiment, the current display channel is a low-resolution channel whose field synchronization signal is Vsync0 and corresponding write controller is the write controller 221 in FIG. 2; and the target display channel is a high-resolution channel whose field synchronization signal is Vsync1 and corresponding write controller is the write controller 222 in FIG. 2. Before and after the display channel is switched, the read control signal follows the field synchronization signal Vsync0, that is, the timing of the read control signal is the same as that of the field synchronization signal Vsync0.

When the display system receives the switching instruction, the switching instruction is separately synchronized to the clock domains of Vsync0, Vsync1 and the read control signal, so as to generate the first switching signal, the second switching signal, and the third switching signal, respectively. The falling edge of the first switching signal and the falling edge of the switching instruction occur at the same time. The falling edge of the second switching signal and the falling edge of the pulse, immediately after the switching instruction, of the field synchronization signal Vsync1 of the target display channel occur at the same time. The falling edge of the third switching signal and the falling edge of the pulse of the read control signal immediately after the switching instruction occur at the same time. That is, n equals to 1.

The first switching signal is sent to the write controller 221, and the write controller 221 stops the write operation immediately under the control of the first switching signal; meanwhile, it is determined in which frame address the write controller 221 completes the final write operation of data, and the frame address (which is the first address) is latched.

The second switching signal is sent to the write controller 222; and after receiving the second switching signal, the write controller 222 sequentially writes data to the frame addresses of the memory 23 respectively starting from the next frame address immediately after the first address. Specifically, the frame address on which the write controller 222 performs write operation is initialized to the first address when the write controller 222 receives the second switching signal; and the write controller 222 performs write operation on the next frame address of the memory 23 at the end of each VBP of the field synchronization signal Vsync1.

The third switching signal is sent to the read controller 223; when receiving the third switching signal, the read controller 223 latches a frame address (that is, the first address) from which the data has been read and reads the data from such frame address again; and then the read controller 223 reads data from a next frame address at the end of each VBP of the read control signal.

For example, as shown in FIG. 4, when the display driving device receives the switching instruction, the write controller 221 has finished writing data to the frame address 1 and begins to write data to the frame address 2, and correspondingly the read controller 223 has finished reading data from the frame address 0 and begins to read data from the frame address 1; under the control of the first switching signal corresponding to the switching instruction, the write controller 221 stops writing the data to the frame address 2. And then under the control of the second switching signal, when the field synchronization signal Vsync1 reaches a falling edge for the first time after the switching instruction, the write controller 222 begins to write data into the frame address 2 in response to the control of the field synchronization signal Vsync1. While the write controller 222 is writing data to the frame address 2, the read controller 223 reads data from the frame address 1 again under the control of the third switching signal.

During a process of performing channel switching according to the embodiments of the present disclosure, the write controller of the current display channel stops performing write operation after the switching instruction is received, and then the write controller of the target display channel begins to perform write operation under the control of the field synchronization signal of the target display channel, and the read controller performs read operation to currently read frame address again or twice when receiving the third switching signal corresponding to the switching instruction, and then sequentially reads data from the frame addresses respectively. In this way, seamless channel switching is realized.

A device for switching a display channel is further provided according to the embodiments of the present disclosure. The device may include storage and a processor that are connected with each other. The storage stores computer executable instructions for controlling one or more processors to perform all or part of the steps of above switching method.

Figure 6:
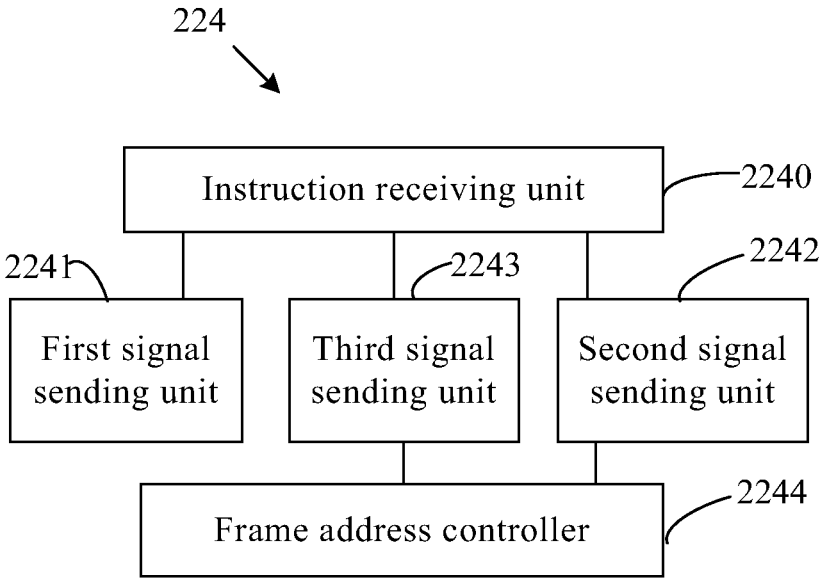
FIG. 6 is a schematic diagram of a device for switching a display channel according to the embodiments of the present disclosure.

FIG. 6 is a schematic diagram of the switching device for display channel according to the embodiments of the present disclosure. As shown in FIG. 6, the switching device includes: an instruction receiving unit 2240, a first signal sending unit 2241, a frame address controller 2244, a second signal sending unit 2242, and a third signal sending unit 2243.

The instruction receiving unit 2240 may receive a switching instruction for switching from a current display channel to a target display channel.

The first signal sending unit 2241 may send a first switching signal to a write controller of the current display channel when the instruction receiving unit 2240 receives the switching instruction, so as to control the write controller of the current display channel to stop writing data to a memory.

The frame address controller 2244 may acquire a frame address in which final write operation of data is completed, and take the frame address as a first address and a frame address immediately after the first address as a second address, when the write controller of the current display channel receives the first switching signal.

The second signal sending unit 2242 may send a second switching signal to a write controller of the target display channel, so as to enable the write controller to, starting from the second address, sequentially write data of the frames of the target display channel into frame addresses of the memory respectively in a predetermined order.

The third signal sending unit 2243 may send a third switching signal to a read controller, so as to enable the read controller to, starting from the first address, sequentially read the data from the frame addresses of the memory in the predetermined order after finishing reading data from the first address under the control of a read control signal.

The first signal sending unit 2241 may synchronize the switching instruction to a clock domain of a field synchronization signal of the current display channel to generate the first switching signal, and send the first switching signal to the write controller of the current display channel.

The second signal sending unit 2242 may synchronize the switching instruction to a clock domain of a field synchronization signal of the target display channel to generate the second switching signal, and send the second switching signal to the write controller of the target display channel.

The third signal sending unit 2243 may synchronize the switching instruction to a current clock domain of the read control signal to generate the third switching signal, and send the third switching signal to the read controller.

Each of the first switching signal, the second switching signal and the third switching signal is a pulse signal. A pulse width of the first switching signal is smaller than that of the field synchronization signal of the current display channel, a pulse width of the second switching signal is smaller than that of the field synchronization signal of the target display channel, and a pulse width of the third switching signal is smaller than that of the read control signal.

Further, a falling edge of the first switching signal and a falling edge of the switching instruction occur at the same time. A falling edge of the second switching signal and the first falling edge, after the switching instruction, of the field synchronization signal of the target display channel occur at the same time. A falling edge of the third switching signal and the first falling edge of the read control signal after the switching instruction occur at the same time.

The read control signal, the field synchronization signal Vsync0 of the current display channel, and the field synchronization signal Vsync1 of the target display channel have the same timing. A pulse interval (i.e., the interval between two adjacent pulses) of the read control signal, a pulse interval of the field synchronization signal Vsync0 of the current display channel, and a pulse interval of the field synchronization signal Vsync1 of the target display channel are equal to one another.

The read control signal is synchronized with the field synchronization signal Vsync0 of the current display channel. The pulses of the read control signal are aligned with the pulses of the field synchronization signal Vsync0 of the current display channel in one-to-one correspondence.

The read control signal is not synchronized with the field synchronization signal Vsync1 of the target display channel. The pulses of the read control signal are not aligned with the pulses of the field synchronization signal Vsync1 of the target display channel.

The principle and the process of switching the display channel are described above and thus will not be repeated here.

A display driving device is further provided according to the embodiments of the present disclosure, and is applied to a display device. As shown in FIG. 2, the display driving device includes: at least two write controllers 221 and 222 in one-to-one correspondence with at least two display channels, the read controller 223, and the switching device 224 according to the above embodiments. The display device may have a low-resolution (e.g. 4K and below) display channel and a high-resolution (e.g. 8K) display channel. In FIG. 2, the write controller 221 is used for the low-resolution display channel, and the write controller 222 is used for the high-resolution display channel.

The write controller 221 or 222 may write the image data of a corresponding display channel into the memory under the control of the field synchronization signal of the corresponding display channel; and the at least two write controllers 221 or 222 may write the data into the memory 23 in a time-division manner. The read controller 223 may read the data from the memory 23 under the control of the read control signal.

The write controller 221 and 222, the read controller 223, and the switching device 224 are integrated in the FPGA chip 22 electrically connected to the memory 23. The display driving device further includes the SOC 21, which transmits display signals (which may include the image data and the field synchronization signal) of the low-resolution channel to the FPGA chip 22.

The FPGA chip 22 further includes: a signal receiving module 225, an image processing module 226, a high definition image receiving module 227 (HDMI Rx), and a signal sending module 228. The low-resolution image data is transmitted by the SOC 21 to the signal receiving module 225, and then is transmitted to the write controller 221 through the image processing module 226 configured to perform image process such as image stretching and image enhancement on the image data. The high definition image receiving module 227 receives the high-definition image data from an image source and transmits the image data to the write controller 222. When a user sends a switching instruction to the display device through a remote control or the like, the SOC 21 transmits the switching instruction to the switching device 224 through an inter-integrated circuit (IIC) 229. The image data read by the read controller 223 is output to a display module by the signal sending module 228.

Figure 7:
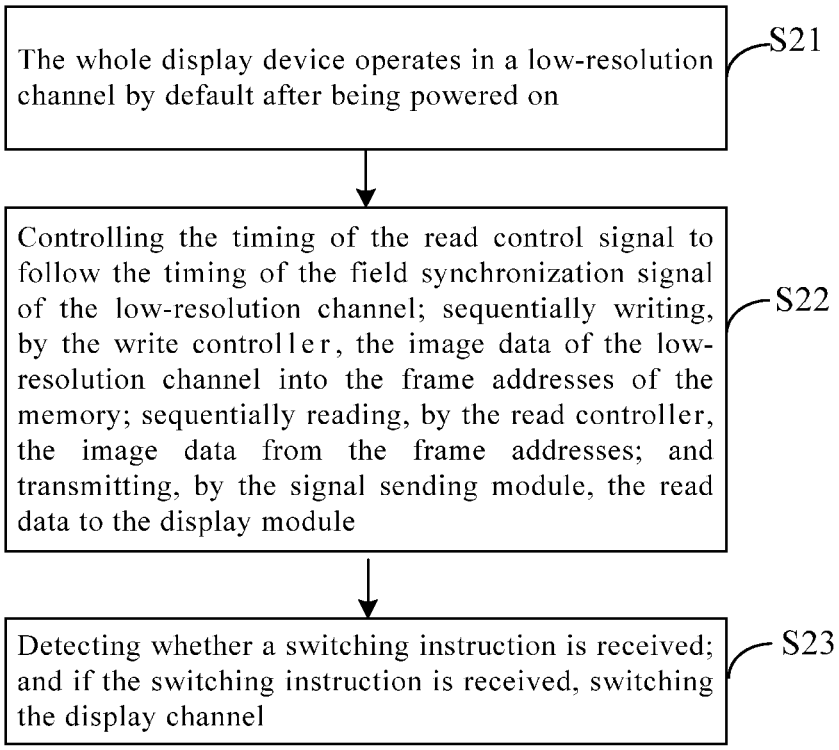
FIG. 7 is a schematic diagram illustrating a process of driving a display module to display with a display driving device.

FIG. 7 is a schematic diagram illustrating a process of driving a display module to display by using a display driving device. As shown in FIG. 7, the driving steps include steps S21 to S23.

At step S21, the whole display device operates in a low-resolution channel by default after being powered on.

At step S22, the timing of the read control signal is controlled to follow the timing of the field synchronization signal of the low-resolution channel; and the write controller sequentially writes the image data of the low-resolution channel to the frame addresses of the memory respectively. The read controller sequentially reads the image data from the frame addresses respectively, and the signal sending module transmits the read data to the display module.

At step S23, it is detected whether a switching instruction is received; if the switching instruction is received, the display channel is switched with the above switching method.

The embodiments of the present disclosure further provide a display device, including a display module configured to display according to the image data read by the read controller, and the display driving device according to the above embodiments.

It should be noted that each of the units, modules, or controllers may be implemented by hardware, software, or a combination thereof. In one embodiment, each unit, module, or controllers can be implemented by an integrated circuit having relevant functions. In another embodiment, each unit, module, or controllers can be implemented by a computer and software stored in a memory of the computer, and a processor of the computer can execute the software for implementing the functions of each unit, module, or controllers.

It should be understood that the above embodiments are merely exemplary embodiments employed to illustrate the principles of the present disclosure, and the present disclosure is not limited thereto. Various changes and modifications can be made by those skilled in the art without departing from the spirit and essence of the present disclosure, and should be considered to fall within the scope of the present disclosure'.

What is claimed is:

1. A method for switching display channels, comprising:

sending a first switching signal to a write controller of a current display channel when a switching instruction for switching from the current display channel to a target display channel is received, so as to control the write controller of the current display channel to stop writing image data to a memory;

acquiring a frame address in which a final write operation of data is completed in the memory, and taking the frame address as a first address and a frame address immediately after the first address as a second address;

sending a second switching signal to a write controller of the target display channel, so as to enable the write controller of the target display channel to, starting from the second address, sequentially write frames of image data of the target display channel into frame addresses of the memory in a predetermined order; and sending a third switching signal to a read controller, so that the read controller, under the control of a read control signal, reads image data in the first address again immediately after the read controller reads out the image data in the first address, and then sequentially reads the image data in the frame addresses of the memory.

2. The method of claim 1, wherein the step of sending the first switching signal to the write controller of the current display channel comprises:

synchronizing the switching instruction to a clock domain of a field synchronization signal of the current display channel to generate the first switching signal, and sending the first switching signal to the write controller of the current display channel.

3. The method of claim 2, wherein the first switching signal is a pulse signal, a pulse width of the first switching signal is smaller than that of the field synchronization signal of the current display channel, and a falling edge of the first switching signal and a falling edge of the switching instruction occur at the same time.

4. The method of claim 3, wherein sending the second switching signal to the write controller of the target display channel comprises:

synchronizing the switching instruction to a clock domain of a field synchronization signal of the target display channel to generate the second switching signal, and sending the second switching signal to the write controller of the target display channel.

5. The method of claim 4, wherein the second switching signal is a pulse signal, a pulse width of the second switching signal is smaller than that of the field synchronization signal of the target display channel, and a falling edge of the second switching signal and a falling edge of a pulse, immediately after the switching instruction, of the field synchronization signal of the target display channel occur at the same time.

6. The method of claim 5, wherein sending the third switching signal to the read control module comprises:

synchronizing the switching instruction to a current clock domain of the read control signal to generate the third switching signal, and sending the third switching signal to the read controller.

7. The method of claim 6, wherein the third switching signal is a pulse signal, a pulse width of the third switching signal is smaller than that of the read control signal, and a falling edge of the third switching signal and a falling edge of a pulse of the read control signal immediately after the switching instruction occur at the same time.

8. The method of claim 7, wherein the read control signal, the field synchronization signal of the current display channel, and the field synchronization signal of the target display channel have a same timing, the read control signal is synchronized with the field synchronization signal of the current display channel, and the read control signal is not synchronized with the field synchronization signal of the target display channel.

9. A device for switching display channels, comprising:

a processor; and a storage with computer executable instructions stored therein, wherein when the computer executable instructions are executed, the processor performs the following steps:

receiving a switching instruction for switching from a current display channel to a target display channel, sending a first switching signal to a write controller of the current display channel when the switching instruction is received, so as to control the write controller of the current display channel to stop writing image data to a memory, acquiring a frame address in which a final write operation of data is completed, and taking the frame address as a first address and a frame address immediately after the first address as a second address when the first switching signal is received by the write controller of the current display channel, sending a second switching signal to a write controller of the target display channel to enable the write controller to, starting from the second address, sequentially write frames of image data of the target display channel into frame addresses of the memory in a predetermined order, and sending a third switching signal to a read controller, so that the read controller, under the control of a read control signal, reads image data in the first address again immediately after the read controller reads out the image data in the first address, and then sequentially reads the image data in the frame addresses of the memory.

10. The device of claim 9, wherein sending the first switching signal to the write controller of the current display channel comprises:

synchronizing the switching instruction to a clock domain of a field synchronization signal of the current display channel to generate the first switching signal, and sending the first switching signal to the write controller of the current display channel.

11. A display driving device, comprising:

the device for switching the display channels of claim 10;

at least two write controllers in one-to-one correspondence with at least two display channels, and configured to respectively write image data of corresponding display channels to the memory in a time-division manner under the control of the field synchronization signals of the corresponding display channels; and the read controller configured to read the image data from the memory under the control of the read control signal.

12. A display device, comprising the display driving device of claim 11 and a display module configured to display based on the image data read by the read controller.

13. The device of claim 10, wherein the first switching signal is a pulse signal, a pulse width of the first switching signal is smaller than that of the field synchronization signal of the current display channel, and a falling edge of the first switching signal and a falling edge of the switching instruction occur at the same time.

14. The device of claim 13, wherein sending the second switching signal to the write controller of the target display channel comprises:

synchronizing the switching instruction to a clock domain of a field synchronization signal of the target display channel to generate the second switching signal, and sending the second switching signal to the write controller of the target display channel.

15. The device of claim 14, wherein the second switching signal is a pulse signal, a pulse width of the second switching signal is smaller than that of the field synchronization signal of the target display channel, and a falling edge of the second switching signal and a falling edge of a pulse, immediately after the switching instruction, of the field synchronization signal of the target display channel occur at the same time.

16. The device of claim 15, wherein sending the third switching signal to the read controller comprises:

synchronizing the switching instruction to a current clock domain of the read control signal to generate the third switching signal, and sending the third switching signal to the read controller.

17. The device of claim 16, wherein the third switching signal is a pulse signal, a pulse width of the third switching signal is smaller than that of the read control signal, and a falling edge of the third switching signal and a falling edge of a pulse of the read control signal immediately after the switching instruction occur at the same time.

18. The device of claim 17, wherein a pulse interval of the read control signal, a pulse interval of the field synchronization signal of the current display channel and a pulse interval of the field synchronization signal of the target display channel are equal to one another, the read control signal is synchronized with the field synchronization signal of the current display channel, and the read control signal is not synchronized with the field synchronization signal of the target display channel.

* * * * *